United States Patent [19]

Pfaue

[11] Patent Number: 5,015,913

[45] Date of Patent: May 14, 1991

[54] HIGH-PRESSURE DISCHARGE LAMP, ESPECIALLY SODIUM VAPOR LAMP

[75] Inventor: Johannès Pfaue, Berlin, Fed. Rep. of Germany

[73] Assignee: Patent Treuhand Gesellschaft fur elektrische Glühlampen m.b.H., Munich, Fed. Rep. of Germany

[21] Appl. No.: 395,354

[22] Filed: Aug. 17, 1989

[30] Foreign Application Priority Data

Sep. 1, 1988 [DE] Fed. Rep. of Germany ..... 3829729

[51] Int. Cl.[5] ..... H01J 17/18; H01J 61/36

[52] U.S. Cl. ..... 313/625; 313/623

[58] Field of Search ..... 313/623, 624, 625

[56] References Cited

U.S. PATENT DOCUMENTS 3,723,784 3/1973 Sulcs et al. ..... 313/47

3,892,993 7/1975 Timmermans ..... 313/623 X

FOREIGN PATENT DOCUMENTS 0074188 3/1983 European Pat. Off. .

2814411 10/1978 Fed. Rep. of Germany .

*Primary Examiner*—Sandra L. O'Shea

*Attorney, Agent, or Firm*—Frishauf, Holtz, Goodman & Woodward

[57] ABSTRACT

A ceramic plug (7) is sintered into an end of a tubular discharge vessel (4, 6). The plug (7) has an opening with a cylindrical portion (12) and a conical portion (13). The conical opening faces the electrode (10, 11) and extends up to an electrode coil (11). The outer surface of the plug having the conical opening is formed with pockets (14) sseparated by radially extending ribs in which metallic fill can condense, electrically insulated and mechanically isolated from the current supply to the electrode. This ensures improved heat transition from the tubular discharge vessel (4, 6) to the plug (7), thereby increasing cold-spot temperature, so that the discharge vessel can be used with sodium high-pressure discharge lamps of improved color rendition indices, as well as for plug-in types and, further, have improved resistance against damage or disturbances caused by shock and vibration.

20 Claims, 5 Drawing Sheets

HIGH-PRESSURE DISCHARGE LAMP, ESPECIALLY SODIUM VAPOR LAMP

Reference to related patent, the disclosure of which is hereby incorporated by reference:

U.S. Pat. No. 3,723,784, Sulcs et al.

Reference to related publications: European Published Patent Application 0 074 188, Denbigh et al German Patent 28 14 411, Jong et al.

The present invention relates to high-pressure discharge lamps, and more particularly to sodium vapor lamps, in which electrode structures are melt-connected to the discharge vessel.

BACKGROUND

High-pressure discharge lamps usually include a tubular discharge vessel of transparent material, for example of transparent ceramic. The tubular discharge vessel is closed by at least one end plug of ceramic material fitted into the tubular discharge vessel, the plug being formed with an opening through which a current supply lead is sealed. An electrode including an electrode support rod and an electrode coil are secured to the current supply lead.

Sodium high-pressure discharge lamps are usually operated in saturated discharge conditions. During operation, only a portion of the fill in the discharge lamp, usually sodium and mercury, will vaporize. The remainder will condense in the form of a liquid amalgam at one or more positions in the discharge vessel at cold spots. In contrast to operation under unsaturated conditions, which is typical for mercury arc discharge lamps, the arc voltage depends highly on the operating conditions of the lamp, including for example ambient surrounding temperatures, supply voltages and the like. Due to the liquid amalgam, changes in cold-spot temperature feed back directly via variations in condensation and vaporization conditions to affect the density of the metal vapor within the lamp, and hence the arc voltage. The arc voltage, in turn, determines the lamp power when the lamp is operated, as is customary, with an inductance or choke. Positive feedback with respect to the cold-spot temperature will result. In operation of a lamp with a "constant wattage" ballast or auxiliary apparatus, positive feedback would not occur. The arc voltage would be affected only by ambient temperature.

Operation of lamps under unsaturated conditions has an advantage due to the high dependence of arc voltage on the operating conditions when the sodium vapor lamps are operated under saturated conditions. Some sodium high-pressure discharge lamps have been placed on the market in which the sodium loss in the discharge vessel has been reduced to such an extent that sufficient lifetime could be obtained without condensed sodium amalgam When using customary materials and production methods, however, for the discharge vessels, sodium loss is still too high that the buffering effect by the condensated sodium amalgam could be eliminated. Mercury, for all practical purposes, does not disappear from the lamp. Loss of sodium, however, causes constant shift of the sodium-to-mercury ratio in the direction of increased proportion of mercury. This shift is particularly high when the entire amalgam has vaporized and decreases when sufficient sodium can be supplied to the gas phase. This permits reduction of increase of arc voltage to a desired extent at a given sodium loss rate; the increase in arc voltage is derived from a change in the mol-relationships. The increase in sodium availability in the discharge vessel thus is capable of reducing the rise in arc voltage.

Two different solutions have been proposed to place the condensate within the discharge vessels.

One solution provides a cold spot outside of the ceramic tube, typically within the exhaust tube, see U.S. Pat. No. 3,723,784, Sulcs et al. The exhaust tube then has the character of an appendix. It is intended to obtain at least approximately reproducible cold-spot temperatures by suitable and careful shaping of this appendix. In this construction, the amalgam condensates at a point external to the surface defined by the ceramic tube. Such a construction has been given the term "external amalgam".

The other solution which has been proposed does not use an appendix but, rather, provides space within the ceramic tube behind the electrodes to collect the amalgam. It is, therefore, located within a surface defined by the ceramic tube, and the condensate in this position has also been referred to as an inner or interior amalgam, see German Patent 28 14 411 and European Published Application 0 074 188.

Customary designs for inner amalgam discharge vessels utilize a tubular ceramic discharge vessel into which a cylindrical ceramic plug having a smooth inner facing surface is fitted, and sealed by a glass solder or glass seal. The cylindrical ceramic plug is formed with a hole, concentric with the axis of the tube, through which a niobium tube or a niobium wire is carried to form the conductive connection to the electrode, as described for example in German Patent 28 14 411. In such a construction, only a small quantity of condensate can collect at the depressions which will then be formed at the ends of the tube and retained thereon by capillary forces even under conditions of vibration or shock. The quantity of amalgam which is necessary to buffer the sodium loss during the lifetime of the lamp usually is larger than that quantity which can be bound by capillary forces and, thus, renders the lamp sensitive with respect to mechanical shocks or other disturbances.

The location at which the actual arc starts on the electrode affects the construction of the inner amalgam discharge vessel. This undesired dependence of arc spot can be reduced if a direct sight line between the amalgam and the electrode is interrupted, see European Patent Application 0 074 188. It has been found particularly undesirable with respect to changes of the cold-spot temperature during the lifetime of the lamp if the discharge arc, upon ignition, can start where the condensate is located, or at the condensate. It may lead to spraying of the amalgam in the vicinity of the electrodes, to extended continued repeated starting of arcing at the amalgam and especially at its forward edge, and to at least partial operation, upon ignition, under half-wave operating conditions.

If the arc starts frequently at the amalgam, an additional disadvantage results: during the lifetime of the lamp, fissures can occur in the transition region from the plug to the ceramic tube based on mechanical damage to the discharge vessel caused by frequent arcing at the amalgam. Further, arcing from the amalgam results in substantial blackening of the discharge vessel tube in the vicinity of the electrodes. This blackening raises the cold-spot temperature and increases the arc voltage. Using a construction in accordance with the European Patent Application 0 074 188 achieves the goal of separation of potentials and renders interruption of the sight line between the electrode and the amalgam only partly effective. This lamp additionally appears to be sensitive to vibration or shock since the circular ring groove has a relatively high cross-sectional dimension.

The influences of the cold-spot temperature on lamp construction and lamp operation are important. These influences have been investigated for these reasons:

It is difficult to reach the arc operating voltage if, to improve the lifetime of the lamps, they are operated under partial loading, that is, in which the wall loading is decreased by increase of the inner diameter.

It is difficult to reach the required cold-spot temperature in sodium high-pressure lamps of less than 50 W rating with customary tubular discharge vessel construction. This difficulty increases as the power rating decreases. There is a definite need for a modified discharge vessel construction to enable obtaining higher cold-spot temperatures.

Lamps which have improved color rendition and which are shorter and have an increased diameter require substantially higher vapor pressure and hence a substantially higher cold-spot temperature than corresponding standard type lamps. It is customary to obtain this increase in temperature by use of heat damming or heat retaining sleeve structures.

Similar considerations apply to sodium high-pressure discharge lamps of the "plug-in" types which are intended to be interchangeable with similar mercury vapor high-pressure lamps without change of accessory or auxiliary apparatus. Such "plug-in" types usually use heat retention structures.

The cold-spot temperature can be influenced in the simplest way by changing the spacing between the tip of the electrode and the closing plug. Increasing the temperature by shortening this distance, however, has limits due to the geometric shape of the arc tubes, and especially if the rearward end of the electrode coil engages against the end of the current supply lead made of niobium. Higher cold-spot temperatures, without changing the ceramic tube construction, can then be obtained only by external heat retention structures, and particularly by heat shields described, for example, in U.S. Pat. No. 3,723,784, Sulcs et al. Assembling such heat shields to the lamp is expensive.

THE INVENTION

It is an object to improve high-pressure discharge lamps, particularly sodium vapor high-pressure lamps, in which the cold-spot temperature is increased with respect to prior constructions without using external heat shields. These lamps use the amalgam sump in the form of an interior or inner amalgam. The collection of a sufficient quantity of amalgam in simple manner should be at a location which is essentially immune to effects of shock or vibration, and which, further, is protected with respect to the arc so that the arc will not start at the amalgam. This location should be such that no line-of-sight relation between the electrode and the amalgam collection area will occur.

It is a further object of the invention to increase the cold-spot temperature with respect to that temperature available in discharge vessels of prior art constructions utilizing the inner or interior amalgam design without requiring external heat shields or heat damming arrangements, while permitting use of the lamp in the above-discussed fields of interest.

Briefly, the plug, as is customary, concentrically surrounds the electrode and extends at least up to the end of the electrode coil which is closest to the plug. In accordance with a feature of the invention, the plug is formed with a circular recess in the surface thereof which faces the interior of the discharge vessel and extends in form of a groove over a portion of the axial length of the plug. The groove is subdivided by a plurality of radially projecting, axially extending ribs which separate the groove into a plurality of pockets. These pockets, in plan view taken on a plane transversely to the axis of the lamp, are essentially of segmental part-circular, part ring shape.

The ribs provided in the groove in accordance with a feature of the present invention have multiple effects. They support the discharge tube with respect to the plug; these ribs are uniformly distributed over the circumference. If they would be omitted, so that the plug would have a continuous uninterrupted circular groove, the portion of the ring groove facing the discharge would shrink during the sintering of the discharge vessel since, to obtain a vacuum-tight sinter connection between the discharge tube and the plug, the discharge tube shrinkage must be made larger than the shrinkage of the plug. When the groove thickness falls below a critical dimension of about 0.3 mm, it is likely that amalgam will condense at the entry edge of the gap formed by the groove rather than, as desired, at its end or bottom Condensation at the bottom leads, successively, to the complete filling of the pockets and thus permit optimal utilization of the storage volume for the condensate which is available.

The ribs further improve substantially the coaxial alignment of the plug in contrast to a plug having only a ring groove. The entire length of the plug can be utilized to align the plug in the tubular discharge vessel, not only the portion of the plug which is between the bottom of the groove and the outer end thereof. Danger of an off-center or off-side dimension of the groove, for example due to tolerances, or due to not exactly coaxial position of the plug, thus is substantially decreased.

Preferably, the recess at the end of the plug is open at the outer diameter so that the circular groove formed thereby, in effect, is defined by the inner wall of the tubular discharge vessel and the outer wall of the recess in the plug. The ribs extend across this groove, and thus engage the inner wall of the tubular discharge vessel structure. A portion of the heat supplied to the plug is derived from the ceramic tube of of the discharge vessel. Heat transition from the tube to the plug is improved by the ribs which extend across this recess. These ribs are sintered to the tube. This increases the cold-spot temperature of the plug element with respect to a plug having a ring-groove therein, in which the ring groove is defined within the plug itself. The ribs provide additional wall portions for the recess for mechanical adhesion of the amalgam by capillary forces. Thus, a plug having individual recess pockets has advantages over a plug with a continuous ring groove.

Various dimensions have been found to be particularly desirable and advantageous. Thus, if the depth T of the pockets is in a range of between 0.3 to 0.8 times of the overall length of the plug, a particularly good cold-spot temperature can be obtained, especially if three or four ribs are uniformly distributed across the cylindrical discharge tube, and the ribs have a width of between about ½ to 1 mm. To obtain particularly high resistance against shock or vibration, the depth T of the pockets is preferably selected to be sufficiently large to obtain a buffer supply of the amalgam of between about 20 to 30 mg.

The overall height or length of the plug can be suitably selected, and the cold-spot temperature will depend on this height or length. The selection cannot be carried out at random; there are limits. Above a critical fill height of the pockets, a new cold spot may occur behind the electrodes and amalgam will start to condense close to the niobium current lead which passes through the bore of the plug. This is undesirable and would avoid reliable galvanic separation between the electrode and electrode supply leads and the amalgam. Lamps in which amalgam condensates behind the electrode exhibit the undesirable ignition conditions in which the arc can strike on the amalgam. In accordance with a feature of the invention, thus, the plugs with the pockets in accordance with the present invention, are preferably so constructed that the bore or opening through which the electrode lead extends expands conically towards the interior of the discharge vessel. This conical expansion results in an improved heat introduction from the discharge to the end of the plug bore towards the end of the plug where the electrode passes therethrough. The level of this heat radiation, resulting in increased temperature, then determines in part the possible increase of the cold-spot temperature. To obtain a particularly good heat radiation effect in this manner, it is desirable to select the conical opening angle as large as possible. This angle should then be so selected that the minimum feasible wall thickness between the pocket and the maximum opening of the cone at least approximately matches the relationship:

$$(d_3-d_2):2-D,$$

wherein $d_3$ is the internal diameter of the discharge vessel, $d_2$ the maximum opening width of the cone forming the outer edge of the opening through the plug, and D is the width of the recess or groove, or of the pocket between the outer wall of the plug and the inner wall of the tubular discharge vessel.

DRAWINGS

Figure 5A:
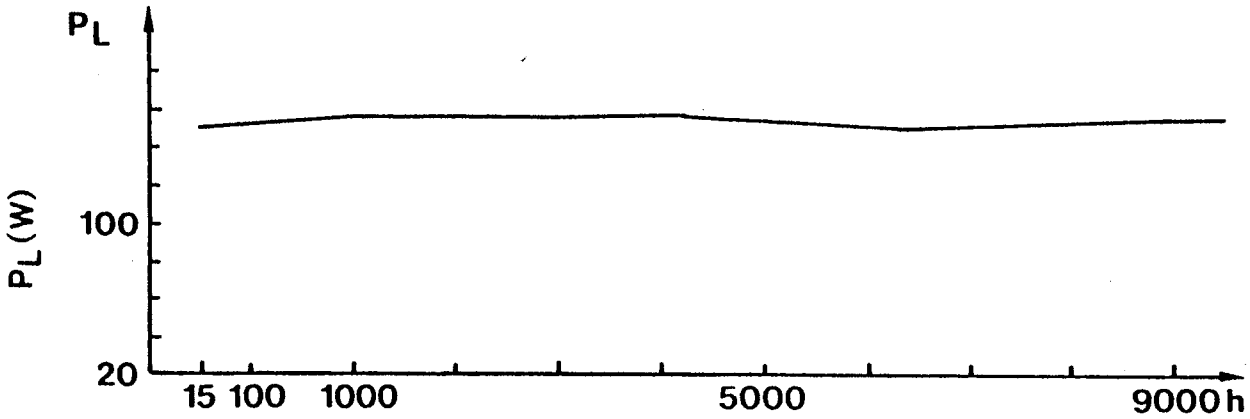
Figure 5B:
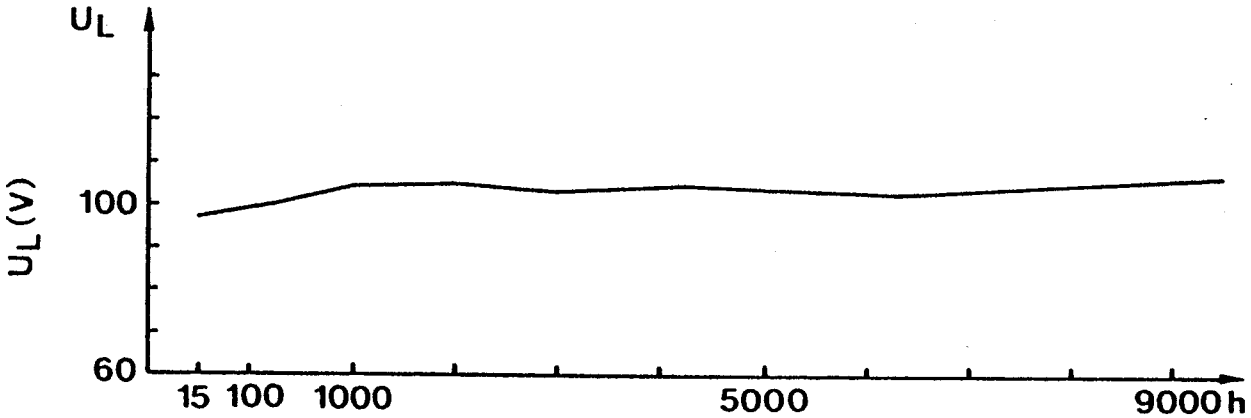
Figure 5C:
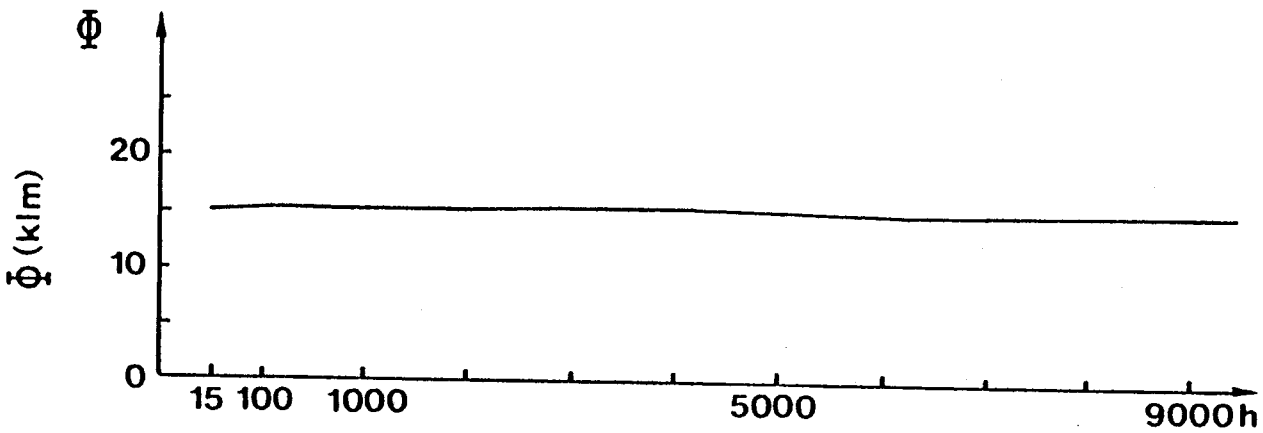
Figure 5D:
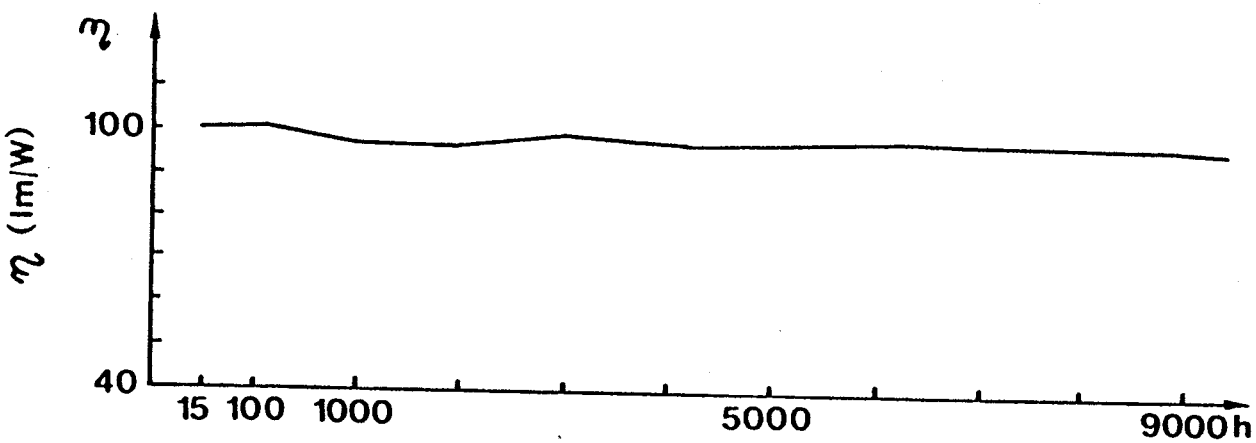

FIG. 5*a* is a graph showing operating time of the lamp with respect to power;

FIG. 5*b* is a graph showing operating time of the lamp with respect to operating voltage;

FIG. 5*c* is a graph showing operating time of the lamp with respect to light flux; and FIG. 5*d* is a graph showing operating time of the lamp with respect to luminous efficiency in lumens per watt.

DETAILED DESCRIPTION

Figure 1:
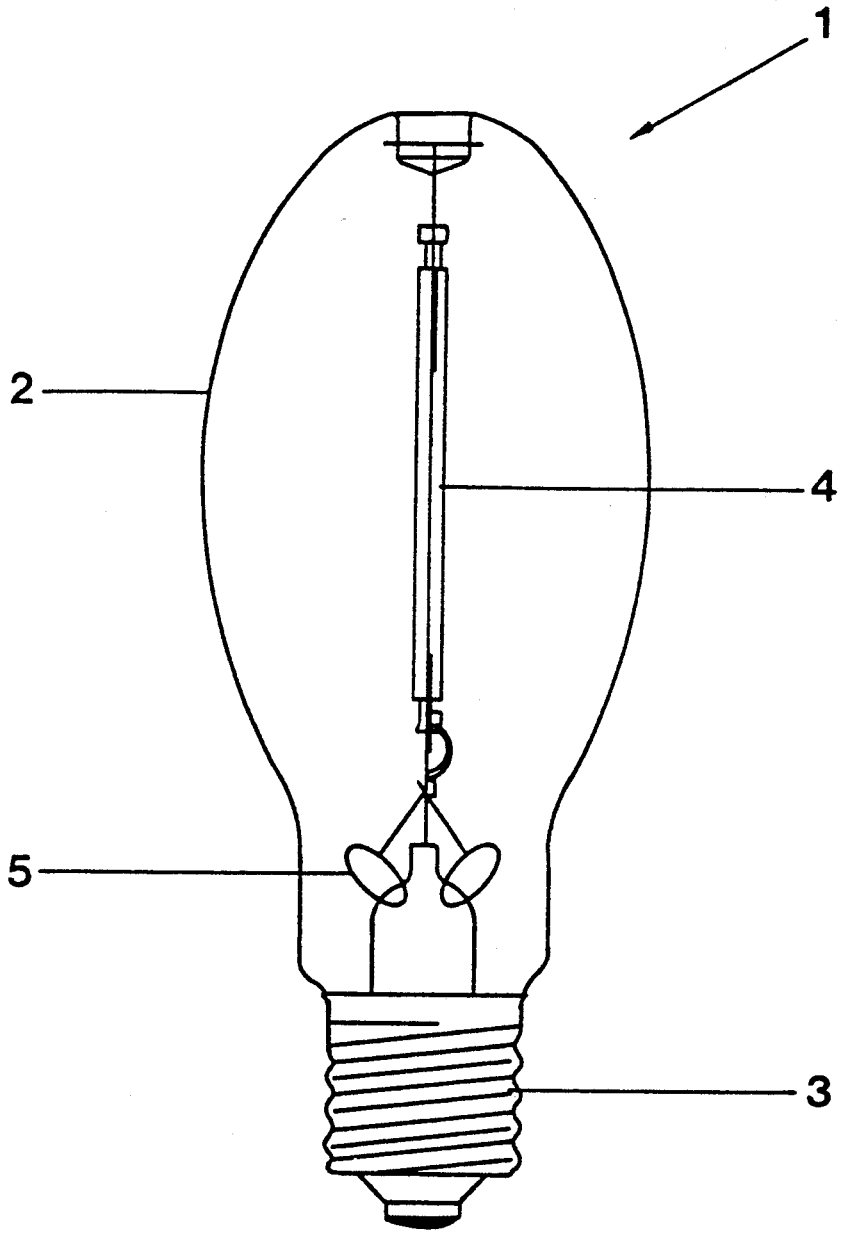
FIG 1 is a schematic side view of a high-pressure sodium discharge lamp having the discharge vessel in accordance with the present invention.

The high-pressure sodium vapor discharge lamp 1 of FIG. 1 is of the type normally designed for 150 W. It has an outer bulb 2 to which a base 3 is attached, for screw-in connection with a suitable socket. The actual discharge vessel 4 is made of polycrystalline aluminum oxide ceramic, retained within the bulb 2. Two getter rings 5 are located within the bulb 2 to improve the vacuum within the bulb 2 and surrounding the discharge vessel 4.

Figure 2:
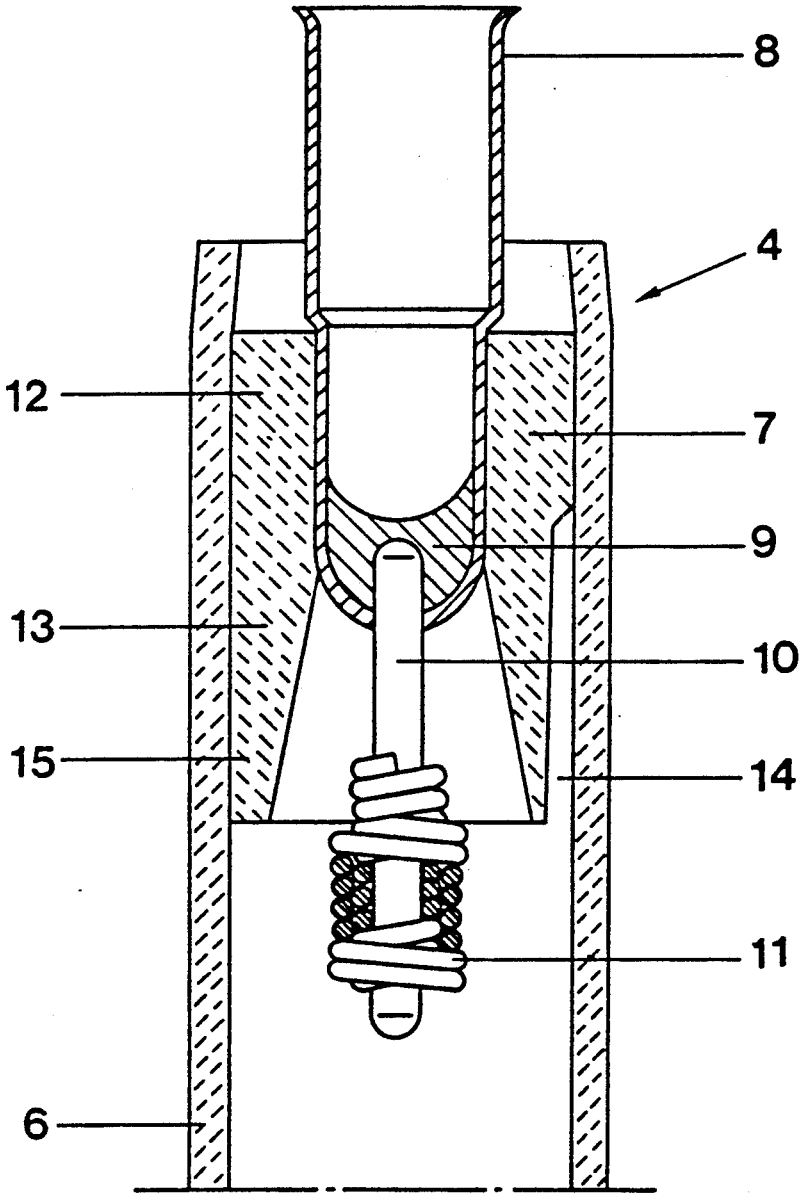
FIG. 2 is an enlarged vertical cross-sectional view of one electrode seal of the discharge vessel.

A tubular body or element 6 of transparent aluminum oxide ceramic is closed off by a plug element 7, also made of aluminum oxide ceramic. The plug 7 is sintered into the tube 6 to be gas-tight. The plug 7 is formed with an axially extending bore or opening through which a current supply element 8, for example in form of a closed tube, is gas-tightly sealed by a glass solder or glass flux or melt connection. Since this is standard in the industry, the glass seal is not specifically shown in FIG. 2. An electrode rod 10 is secured to the current supply element 8 by a titanium solder 9. An electrode coil 11 is wrapped around the electrode rod 10. The lower electrode structure and termination of the tube 6 can be identical to the structure just described.

Figure 3:
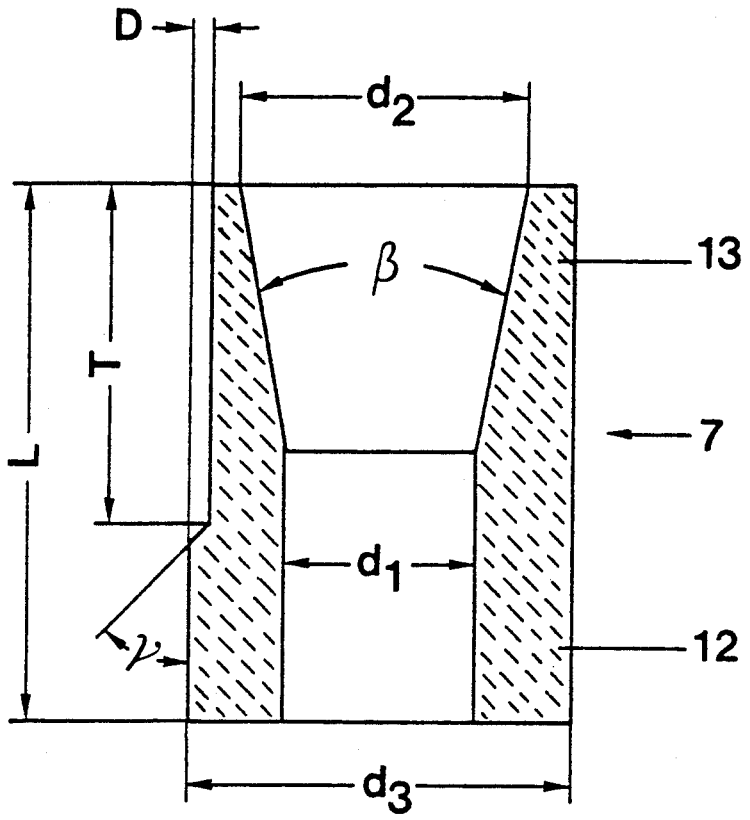
FIG. 3 is a vertical cross-sectional view through the plug, reversed 180° with respect to the illustration of FIG. 2, to a different scale and illustrating dimensions, the significance of which will be described in the descriptive portion of the specification.
Figure 4:
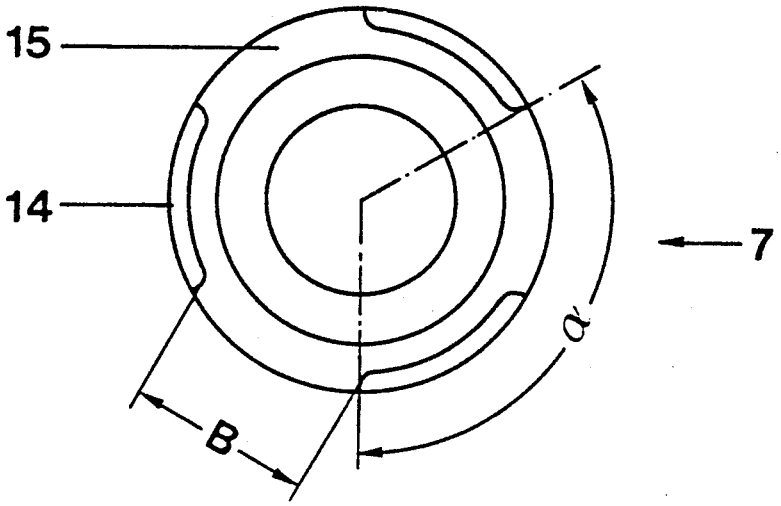
FIG. 4 is a top view of the plug of FIG. 3.

FIGS. 3 and 4 illustrate the plug 7 removed from the vessel or tube 6. The plug 7 includes a cylindrical portion 12 and an end portion 13, which is formed with a conical bore. The length L (FIG. 3) of the plug 7 is so dimensioned that the inwardly conical portion 13 which faces the discharge space extends beyond that portion of the electrode coil 11 which is remote from the discharge or arc region. The conically enlarged bore of the portion 13 faces the electrode rod 10 and the electrode coil 11. The opening angle $\beta$ of the conical opening 13 should be as large as possible for optimum operation of the lamp. The outer end surface of the plug 7 defines three part-segmental pockets 14 at the surface of the plug 7 remote from the electrode rod 10 and the electrode coil 11. The pockets 14 are uniformly distributed about the circumference of the plug 7. The pockets 14 are formed by ribs 15 which interrupt a depression or recess formed in the outer circumference of the plug 7. The pockets 14 are all of equal size and the ribs 15 likewise are of equal size. The segmental angle $\alpha$ of any pocket 14, together with one rib 15, in the example selected, together is 120°.

The following dimensions for a lamp of 150 W rating of the sodium high-pressure discharge type are suitable:

| | |
|---|---|
| tubular body 6: | |
| length | about 86 mm |
| outer diameter (OD) | about 7.4 mm |
| inner diameter (ID) | about 6 mm. |
| plug 7: | |
| overall length L | about 9 mm |
| axial bore diameter $d_1$ | about 3.1 mm |
| maximum diameter $d_2$ | 5 mm |
| opening angle $\beta$ | 24° |
| outer diameter $d_3 = I_d$ of tube 6 | about 6 mm |
| depth T of pocket 14 | about 5.5 mm |
| width D of pockets 14 | 0.4 mm. |

The transition at the bottom of the pocket 14 to the outer diameter $d_3$ of the plug 7 preferably is angled, the angle $\gamma$ being preferably about 45°. The width D of the pocket 14 depends on the outer diameter $d_3$ of the plug 7 and the maximum diameter $d_2$ of the opening of the conical portion 13, as well as material and strength requirements of the remaining wall portion at the inner facing end of the plug.

The dimension of 0.4 mm is suitable for the width D of a 150 W lamp.

Operating parameters of the 150 W sodium high-pressure discharge lamp during operation are shown in FIGS. 5*a* to 5*d*. As can be seen, there is little variation in any of the operating characteristics throughout an operating life of at least 9000 hours. Electrical power $P_L$ (FIG. 5*a*) of the lamp 1 varies only within a very narrow range of only about 5 W from rated power, shown on the ordinate at $P_L$ in watts (W). The operating voltage $U_L$ in volts (V) is shown in FIG. 5*b* which, during that time, shows only a very slight rise of about 5 V, starting from about 100 V with a lamp which is aged for about 100 hours. The light flux $\phi$ of FIG. 5*c* in kilolumens (klm) is essentially uniform during the entire operating time of 9000 hours. No variation could be measured and, uniformly, provides 15000 lumens. The light efficiency $\eta$ in lumens per watt (lm/W), as seen in FIG. 5*d*, remains essentially constant at 100 lm/W, with a slight drop of about 4% distributed over essentially the entire operating period of the lamp.

As can be seen from the graphs 5*a* to 5*d*, the variations in operating characteristics over a substantial operating period are negligible.

The dimensions given for the 150 W lamp are illustrative; they can be varied, suitably, for lamps of other power. Generally, the depth T of the pockets (14) is defined by the range of the relationship:

$$0.3\ L \leqq T \leqq 0.8\ L,$$

wherein

L is the overall length of the plug (7);

T is the depth of the pockets formed by said recess or groove;

wherein

The width (D) of the pockets (14) is in the range defined by the relationship $$0.3\ \text{mm} \leqq D \leqq (d_3 - d_1):4,$$

wherein $d_1$ is the diameter of an opening in the end plug (7) through which said current supply lead extends, $d_3$ is the outer diameter of the end plug (7); and D is the radial dimension of the pockets formed by the recess or groove.

Various changes and modifications may be made within the scope of the inventive concept.

I claim:

1. High-pressure discharge lamp having a tubular discharge vessel (4, 6) of transparent ceramic material, defining a lamp axis;

at least one essentially cylindrical end plug (7) of ceramic material fitted into the tubular discharge vessel and formed with a concentric opening therein;

a current supply lead (8) tightly sealed through said opening in the at least one end plug;

an electrode including an electrode support rod (10) and an electrode coil (11) secured to said current supply lead, wherein the plug (7) concentrically surrounds the electrode and extends at least up to the end of the electrode coil which is closest to said plug, the outer circumference of the plug is formed with a circular recess in the surface thereof facing the interior of the discharge vessel and extending, in form of a groove, over a portion of the axial length (L) of said plug; and wherein a plurality of radially projecting, axially extending ribs (15) are provided, projecting across said groove to the inner wall of said discharge vessel (4, 6) and separating the groove in to a plurality of pockets (14) which, in plan view transverse to the axis of the lamp, are of essentially segmental part-circular ring shape.

2. The lamp of claim 1, wherein said ribs (15) have relative uniform spacing from each other around the circumference of said groove and along said wall of the plug to form the pockets (14), so that said pockets will be of uniform size.

3. The lamp of claim 1, wherein the depth (T) of the pockets (14) is defined by the range of the relationship:

$$0.3\ L \leqq T \leqq 0.8\ L,$$

wherein

L is the overall length of the plug (7); and

T is the depth of the pockets formed by said recess or groove.

4. The lamp of claim 1, wherein the width (D) of the pockets (14) is in the range defined by the relationship $$0.3\ \text{mm} \leqq D \leqq (d_3 - d_1):4,$$

wherein $d_3$ is the diameter of an opening in the end plug (7) through which said current supply lead extends, $d_3$ is the outer diameter of the end plug (7); and D is the radial dimension of the pockets formed by the recess or groove.

5. The lamp of claim 4, wherein the depth (T) of the pockets (14) is defined by the range of the relationship:

$$0.3\ L \leqq T \leqq 0.8\ L,$$

wherein

L is the overall length of the plug (7);and

T is the depth of the pockets formed by said recess or groove.

6. The lamp of claim 1, wherein the angle ($\alpha$) defined by the circumferential extent of one rib (15) and an adjacent pocket (14) is between 90° to 120°.

7. The lamp of claim 1, wherein the circumferential extent (B) of any rib (15) is between 0.5 mm to 1 mm.

8. The lamp of claim 6, wherein the circumferential extent (B) of any rib (15) is between 0.5 mm to 1 mm.

9. The lamp of claim 1, wherein three ribs (15) and three pockets are provided.

10. The lamp of claim 1, wherein the concentric opening has a cylindrical portion (12) into which said current supply lead is sealed and a part-conical portion (13) extending from the cylindrical portion and terminating with a wider part thereof at an end face of said plug.

11. The lamp of claim 10, wherein the enlarged part of the conical portion (13) faces the electrode.

12. The lamp of claim 11, wherein the depth (T) of the pockets (14) is defined by the range of the relationship:

$$0.3\ L \leqq T \leqq 0.8\ L,$$

wherein

L is the overall length of the plug (7);

T is the depth of the pockets formed by said recess or groove;

wherein the width (D) of the pockets (14) is in the range defined by the relationship $$0.3\ \text{mm} \leqq D \leqq (d_3 - d_1):4,$$

wherein $d_1$ is the diameter of an opening in the end plug (7) through which said current supply lead extends, $d_3$ is the outer diameter of the end plug (7); and D is the radial dimension of the pockets formed by the recess or groove.

13. The lamp of claim 11, wherein the angle ($\alpha$) defined by the circumferential extent of one rib (15) and an adjacent pocket (14) is between 90° to 120°; and wherein the circumferential extent (B) of any rib (15) is between 0.5 mm to 1 mm.

14. The lamp of claim 12, wherein the angle ($\alpha$) defined by the circumferential extent of one rib (15) and an adjacent pocket (14) is between 90° to 120°; and wherein the circumferential extent (B) of any rib (15) is between 0.5 mm to 1 mm.

15. The lamp of claim 1, wherein said ribs (15) project radially outwardly across said recess towards and in contact with the inner wall of said tubular discharge vessel and are secured to said inner wall.

16. The lamp of claim 15, wherein the ribs are sintered to the inner wall of the discharge vessel (6).

17. The lamp of claim 1, wherein said pockets are defined by a surface of said plug delimiting the circular recess; an inner wall surface of said tubular discharge vessel (4, 6); lateral surfaces of adjacent ribs; and a bottom surface of said recess extending from said recess of the plug towards the inner wall of said tubular vessel.

18. The lamp of claim 17, wherein the bottom surface of said recess is slanted outwardly towards the inner wall of the tubular vessel.

19. The lamp of claim 17, wherein the bottom surface of said recess is slanted outwardly towards the inner wall of the tubular vessel at an angle in the order of about 45°.

20. The lamp of claim 1, wherein the width (D) of the pockets (14) is in the range defined by the relationship $$0.3\ \text{mm} \leqq D \leqq (d_3 - d_1):4,$$

wherein $d_1$ is the diameter of an opening in the end plug (7) through which said current supply lead extends, $d_3$ is the outer diameter of the end plug (7);

D is the radial dimension of the pockets formed by the recess or groove; and wherein the depth (T) of the pockets (14) is defined by the range of the relationship:

$$0.3\ L \leqq T \leqq 0.8\ L,$$

wherein

L is the overall length of the plug (7);and

T is the depth of the pockets formed by said recess or groove.

* * * * *